US011490777B2

(12) United States Patent
Zhang

(10) Patent No.: US 11,490,777 B2
(45) Date of Patent: Nov. 8, 2022

(54) MOP CLEANING DEVICE

(71) Applicant: JIAXING JACKSON TRAVEL PRODUCTS CO., LTD, Jiaxing (CN)

(72) Inventor: Ju Hong Zhang, Jiaxing (CN)

(73) Assignee: JIAXING JACKSON TRAVEL PRODUCTS CO., LTD, Jiaxing (CN)

( * ) Notice: Subject to any disclaimer, the term of this patent is extended or adjusted under 35 U.S.C. 154(b) by 366 days.

(21) Appl. No.: 16/854,916

(22) Filed: Apr. 22, 2020

(65) Prior Publication Data

US 2020/0352407 A1 Nov. 12, 2020

(30) Foreign Application Priority Data

May 9, 2019 (CN) ..... 201910384213.1

(51) Int. Cl.
*A47L 13/502* (2006.01)
*B08B 3/02* (2006.01)
*B08B 7/02* (2006.01)

(52) U.S. Cl.
CPC ..... *A47L 13/502* (2013.01); *B08B 3/02* (2013.01); *B08B 7/02* (2013.01)

(58) Field of Classification Search
None
See application file for complete search history.

(56) References Cited

U.S. PATENT DOCUMENTS

2008/0295870 A1* 12/2008 Perelli ..... A47L 13/22 134/201
2009/0265876 A1* 10/2009 Gardner ..... B08B 13/00 15/322
2011/0118680 A1* 5/2011 Michaels ..... A61M 1/0023 604/317

* cited by examiner

*Primary Examiner* — Eric W Golightly
(74) *Attorney, Agent, or Firm* — Bayramoglu Law Offices LLC

(57) ABSTRACT

A mop cleaning device includes an outer bucket, a water pump, a big cavity and a small cavity, wherein the big cavity and the small cavity are used for storing liquid, and the water volume of the big cavity is greater than that of the small cavity; the big cavity communicates with the small cavity, a valve for controlling communication of the big cavity and the small cavity is arranged between the big cavity and the small cavity, the water pump communicates with the small cavity and pumps water from the small cavity, and the outer bucket is provided with a support abutting against a mop head of a mop; and when the mop is cleaned, the valve is controlled to close a water passage between the big cavity and the small cavity, and the water pump pumps water from the small cavity to the mop to fulfill cleaning.

23 Claims, 5 Drawing Sheets

MOP CLEANING DEVICE

CROSS REFERENCE TO THE RELATED APPLICATIONS

This application is based on and claims priority to Chinese Patent Application No. 201910384213.1, filed on May 9, 2019, the entire contents of which are incorporated herein by reference.

TECHNICAL FIELD

The invention relates to a mop cleaning device.

BACKGROUND

Mops are common cleaning instruments used by people in daily life. An existing patent literature disclosed a rotary mop bucket which includes a bucket body, a rotary washing tank located on the right side of the interior of the bucket body, a spin-drying basket located on the left side of the interior of the bucket body, and a filter screen and a water guide plate which are located on the left side of the interior of the bucket body, wherein the water guide plate is clamped on the bucket body by means of a concave clamping groove and is formed with a water inlet and a water outlet, and the filter screen is detachably connected to the water inlet in the water guide plate. In this technical solution, the mop bucket is partitioned into two regions which are separately used for cleaning and spin-drying, and thus, the structure is large, and production and logistics costs are high.

To overcome the defects of the aforesaid technique, a lifting mop bucket is developed, wherein a rotary basket of the mop bucket is arranged over the bucket body; when a mop need to be spin-dried, the rotary basket is lifted above the bucket body to drive the mop disc of the mop to rotate at a high speed to realize rapid spin-drying of the mop; and when the mop needs to be cleaned, the rotary basket is lowered below the bucket body, so that the mop is immersed in water to be cleaned. The rotary basket and the bucket body of the lifting mop bucket are vertically arranged, so that the size of the bucket body is reduced, and a small space is occupied. However, the lifting structure is complicated, and the assembly efficiency is low; and due to the fact that all parts of the lifting mop bucket are made of plastic, the precision is poor, and the lifting structure may get stuck in use and cannot rise or fall anymore.

SUMMARY

The objective of the invention is to overcome the aforementioned defects of the prior art by providing a mop cleaning device which is reasonable in structural design and low in production cost.

The technical solution adopted by the invention to settle the above technical issues is as follows: a mop cleaning device comprises an outer bucket, a water pump, a big cavity and a small cavity, wherein the big cavity and the small cavity are used for storing liquid, and the water volume of the big cavity is greater than that of the small cavity; the big cavity is communicated with the small cavity, a valve for controlling on/off of the big cavity and the small cavity is arranged between the big cavity and the small cavity, the water pump is communicated with the small cavity and pump waters from the small cavity, and the outer bucket is provided with a support abutting against a mop head of a mop; when the mop is cleaned, the valve is controlled to close a water passage between the big cavity and the small cavity, and the water pump pumps water from the small cavity to the mop to fulfill cleaning; and when water in the small cavity is used up, the mop rotates to be centrifugally spin-dried, and water generated during spin-drying flows to the outer bucket.

Specifically, the support is movably arranged in the vertical direction; and the mop is placed on the support when cleaned, and then the support moves downwards to drive the valve to close the water passage between the big cavity and the small cavity.

Specifically, the mop head of the mop is placed on the support, and when rotating, the mop head drives the water pump to pump water from the small cavity to the mop.

Specifically, the water pump is an impeller pump.

Specifically, the water pump comprises a cylinder formed with a water inlet, a spiral blade which spirally extends along the inner wall of the cylinder from bottom to top is arranged in the cylinder, and cylinder is able to rotate with respect to the outer bucket.

Specifically, the inner diameter of the cylinder is gradually increased from bottom to top.

Specifically, the support is fixedly connected to the cylinder.

Specifically, the big cavity and the small cavity are formed by partitioning an inner bucket which is arranged in the outer bucket, a partition plate is arranged in the inner bucket, and a gap is formed between the partition plate and the inner wall of the inner bucket; and the partition plate extends from an opening to the bottom of the inner bucket and is connected to the inner wall or the bottom surface of the inner bucket, a space formed between the outer side of the partition plate and the inner bucket is the big cavity, and a space defined by the inner side of the partition plate is the small cavity, and the partition plate has a water passage.

Specifically, the small cavity is arranged in the outer bucket, and the big cavity is arranged beside the small cavity.

Specifically, the partition plate is centrally symmetrically distributed with respect to the central axis of the inner bucket, and the support is coaxial with the inner bucket.

Specifically, the mop cleaning device further comprises an elastic part, wherein the elastic part applies a force to the valve to enable to the valve to open the water passage between the big cavity and the small cavity; and when the mop head is placed on the support, the resistance from the elastic part is overcome, and the valve closes the water passage between the big cavity and the small cavity Specifically, the water passage is a through hole formed in the partition plate, the valve is a plug connected to the cylinder, and the elastic part applies to a force to the plug or the cylinder to enable the plug to move away from the through hole; and when the mop head is placed on the support, the cylinder overcomes the resistance from the elastic part to drive the plug to move close to the through hole to block the water passage.

Specifically, an inner cylinder is arranged in the cylinder, a gap is formed between the inner cylinder and the cylinder, and the inner cylinder is coaxial with the cylinder and is fixedly or rotatably connected to the cylinder.

Specifically, the inner cylinder is fixedly connected to the cylinder, and the support is fixedly connected to the inner cylinder.

Specifically, a water outlet of the water pump is arranged in an inner bucket area.

Specifically, the inner bucket, the cylinder and the support are arranged coaxially, and the cylinder is arranged inside the inner side of the partition plate.

Specifically, the water passage is a through hole formed in the partition plate, the valve is a plug connected to the cylinder, and the elastic piece applies to a force to the plug or the cylinder to enable the plug to move away from the through hole; and when the mop head is placed on the support, the cylinder overcomes the resistance from the elastic part to drive the plug to move close to the through hole to block the water passage.

Specifically, the water outlet of the water pump is connected to a water cavity through a pipe, and a cleaning roller which rotates with the axis thereof as a rotation axis is rotatably arranged in the water cavity; and when the mop is cleaned, the mop head rotates to drive the cleaning roller to rotate, and the water pump pumps water from the small cavity and then delivers the water to the mop head by means of the cleaning roller.

Specifically, the mop is a rotary mop, the outer bucket is provided with a support frame, a mop rod of the mop is provided with a hanger, and when the mop is cleaned, the support frame supports the hanger to restrain of the mop from moving downwards.

Specifically, the support frame has a notch, and the inner diameter of the notch is smaller than the outer diameter of the hanger.

Compared with the prior art, the invention has the following advantages: when the mop cleaning device is used, the mop head can be cleaned and spin-dried at the same position, cleaning and spin-drying can be switched through a simple and reliable mechanism, and the production cost is low.

Figure 1:
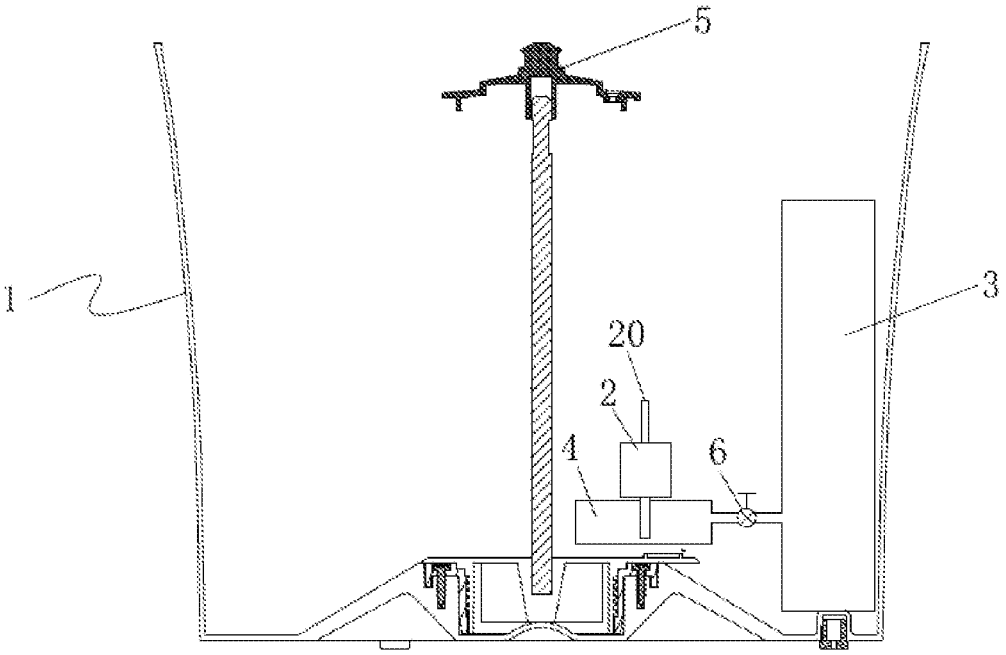
FIG. 1 is a structural diagram of an embodiment.

1, outer bucket; 11, support frame; 11*a*, notch; 2, water pump; 21, cylinder; 22, spiral blade; 23, inner cylinder; 20, water outlet; 210, water inlet; 3, big cavity; 4, small cavity; 5, support; 6, valve; 7, elastic part; 8, cleaning roller; 9, water cavity; a, mop head; b, inner bucket; b1, partition plate; c, hanger.

DETAILED DESCRIPTION OF THE EMBODIMENTS

To make the objectives, technical solutions and advantages of the invention clearer, the invention is further expounded below in conjunction with the accompanying drawings and embodiments. It should be understood that the specific embodiments described hereinafter are only used to explain the invention, and are not intended to limit the invention.

As shown in FIG. 1 to FIG. 7, this embodiment provides a mop cleaning device which comprises an outer bucket 1, a water pump 2, a big cavity 3 and a small cavity 4, wherein the big cavity 3 and the small cavity 4 are used for storing liquid, and the water volume of the big cavity 3 is greater than that of the small cavity 4; the big cavity 4 is communicated with the small cavity 4, so that water stored in the big cavity 3 can flow into the small cavity 4; a valve 6 for controlling on/off of the big cavity 3 and the small cavity 4 is arranged between the big cavity 3 and the small cavity 4; the water pump 2 is communicated with the small cavity 4 and pumps water from the small cavity 4; and a support 5 abutting against a mop head a of a mop is arranged in the outer bucket 1 and is supported by the outer bucket 1. When the mop is cleaned, the valve 6 is controlled to close a water passage between the big cavity 3 and the small cavity 4, and the water pump 2 pumps water from the small cavity 4 to the mop to fulfill cleaning. When water in the small cavity 4 is used up, the mop rotates to be centrifugally spin-dried, and water generated during spin-drying flows to the outer bucket 1. When the invention is implemented, the big cavity 3 is filled with water at first, the water passage is kept open to allow water to flow to the small cavity 4 from the big cavity 3; when the mop is cleaned, the valve 6 is controlled manually or through the mop to close the water passage between the big cavity 3 and the small cavity 4, and the water pump 2 operates to pump water from the small cavity 4 to the mop so as to clean the mop; and when water in the small cavity 4 is used up, the mop rotates to be centrifugally spin-dried. In this embodiment, the water pump 2 is an electric pump or a hand pump and is used to deliver water. In this embodiment, the quantity of water used for cleaning the mop is constant, clean water stored in the big cavity 3 is used to clean the mop every time, and waste water generated after cleaning flows to the outer bucket 1. In this embodiment, the valve 6 includes conventional water valves in the prior art or simplified ones thereof, and is, for example, a valve element, a plug or a baffle that can control the on-off of water.

Preferably, when this embodiment is implemented, the valve 6 is controlled through the support 5 to facilitate usage, and the support 5 is movably arranged in the vertical direction; and when cleaned, the mop is placed on the support 5, and then the support 5 moves downwards to drive the valve 6 to close the water passage between the big cavity 3 and the small cavity 4.

Preferably, the water pump 2 is a hand pump which is driven by rotation of the mop head a which is placed on the support 5, and when rotating, the mop head a drives the water pump 2 to pump water thereto from the small cavity 4. In a specific implementation, the support 5 is quadrilateral, pentagonal or hexagonal, a concave cavity matched with the support 5 is formed in a lower part of the mop head a, the support 5 is inlaid in the concave cavity to be positioned in the circumferential direction, and when the mop head a rotates, the support 5 rotates accordingly. In the case where the water pump 2 is an impeller pump, the support 5 is connected to an impeller of the impeller pump, so that when the support 5 rotates, the impeller will be driven to rotate accordingly to drive the water pump 2 to operate.

Figure 2:
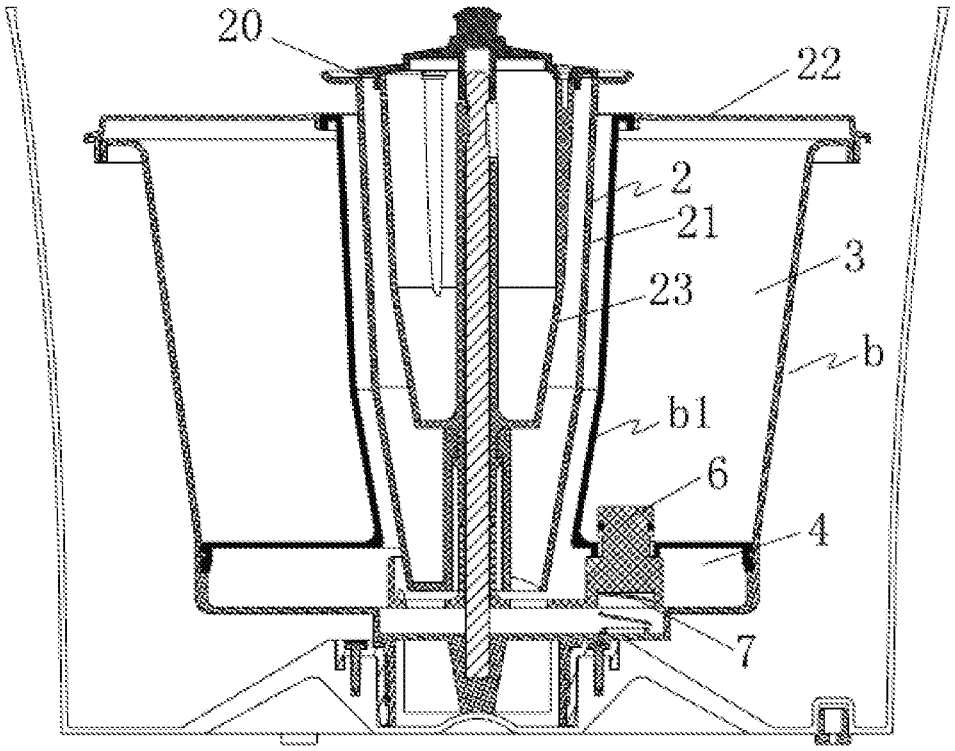
FIG. 2 is a structural diagram of the embodiment adopting a cylinder.
Figure 3:
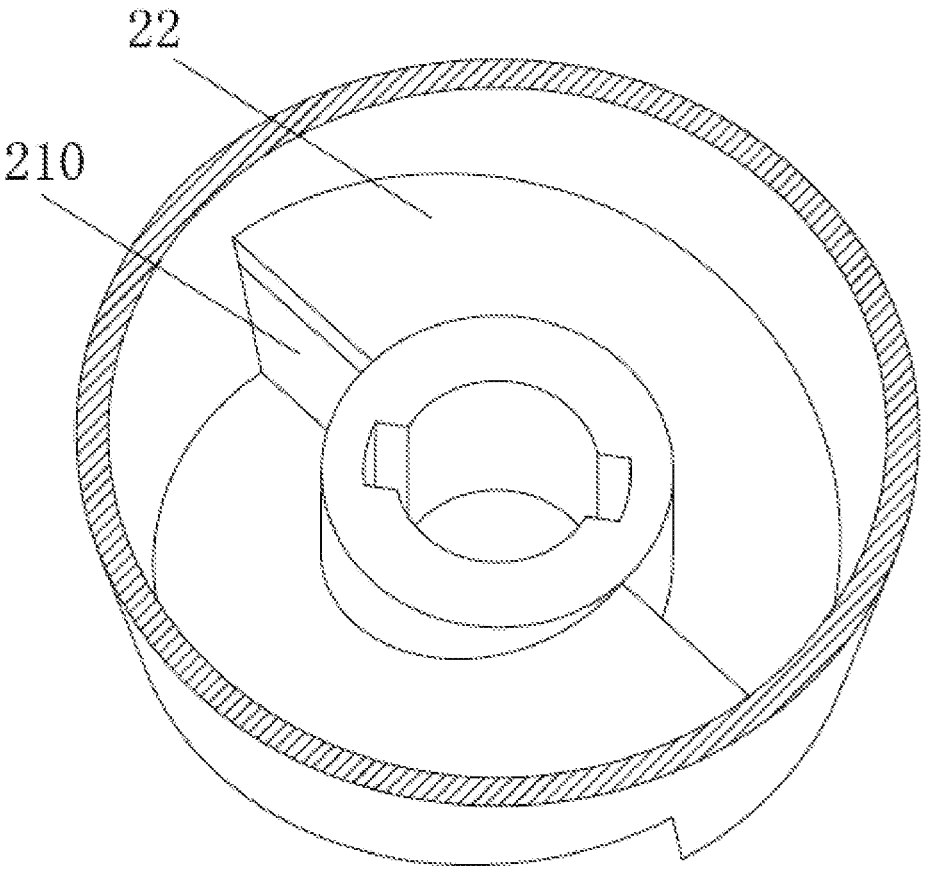
FIG. 3 is a structural diagram of a cylinder of a water pump of the embodiment.
Figure 4:
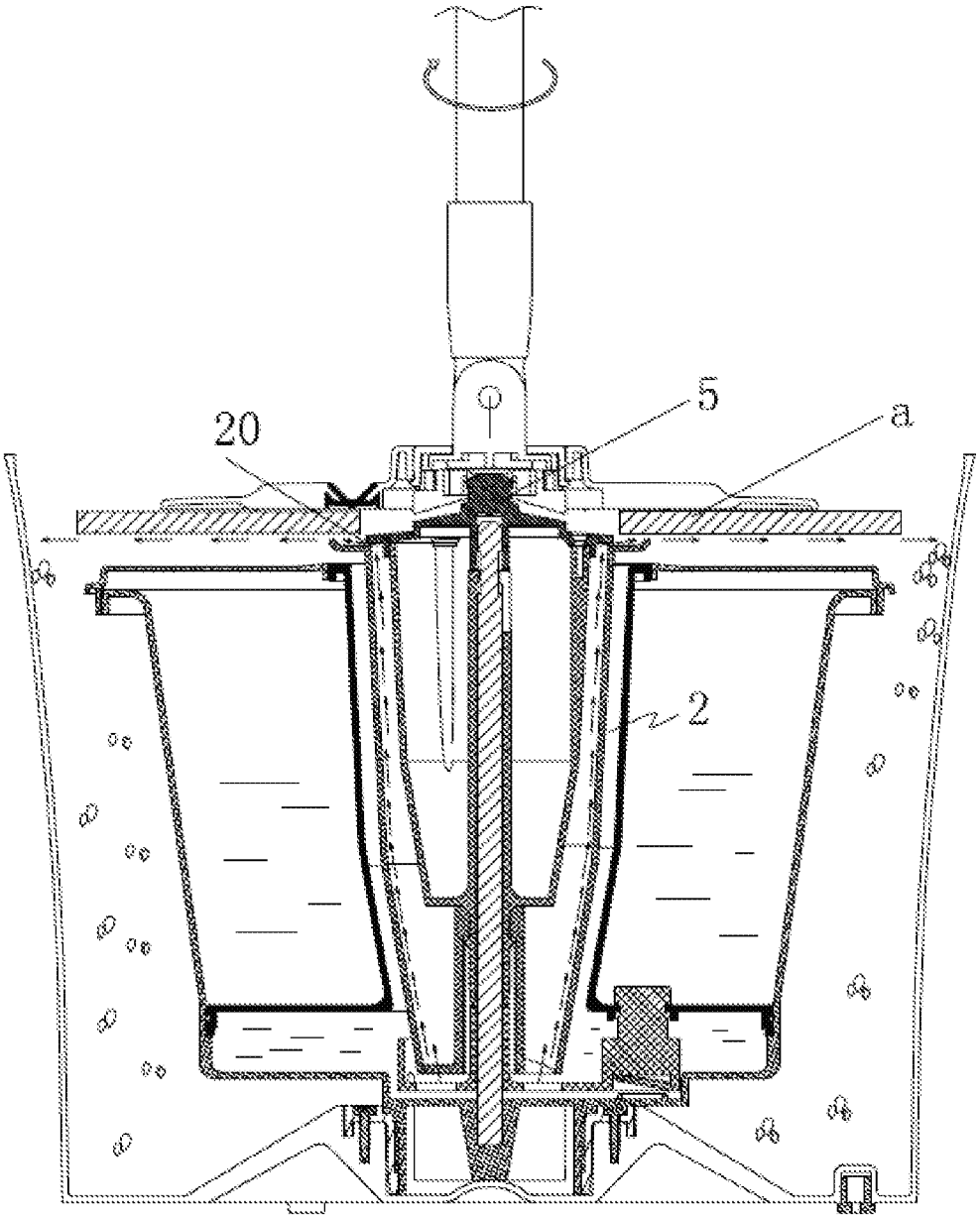
FIG. 4 is a structural diagram of the embodiment adopting the cylinder and used in cooperation with a mop.

In a preferred implementation of the water pump 2, as shown in FIG. 2 to FIG. 4, the water pump 2 comprises a cylinder 21 formed with a water inlet 210, and the water inlet 210 preferably faces the rotation trajectory of the cylinder 21; a spiral blade 22 which spirally extends along the inner wall of the cylinder 21 from bottom to top is arranged in the cylinder 21, and the cylinder 21 is able to rotate with respect to the outer bucket 1. In this embodiment, the cylinder 21 is preferably cylindrical and rotates with the central axis thereof as a rotation axis, and the water inlet 210 is formed in the small cavity 4 and is used for getting water from the small cavity 4. In a specific implementation, the mop head a rotates to drive the cylinder 21 to rotate through the support 5, and further preferably, the support 5 is fixedly connected to the cylinder 21.

In this embodiment, as shown in FIG. 2, the inner diameter of the cylinder 21 is gradually increased from bottom to top, that is, an inner cavity of the cylinder 21 is of a big-end-down structure, so that compared with a vertical plane, water can be delivered from bottom to top more easily, the water delivery area is enlarged, and water can flow to the mop head a from a wider region.

Figure 5:
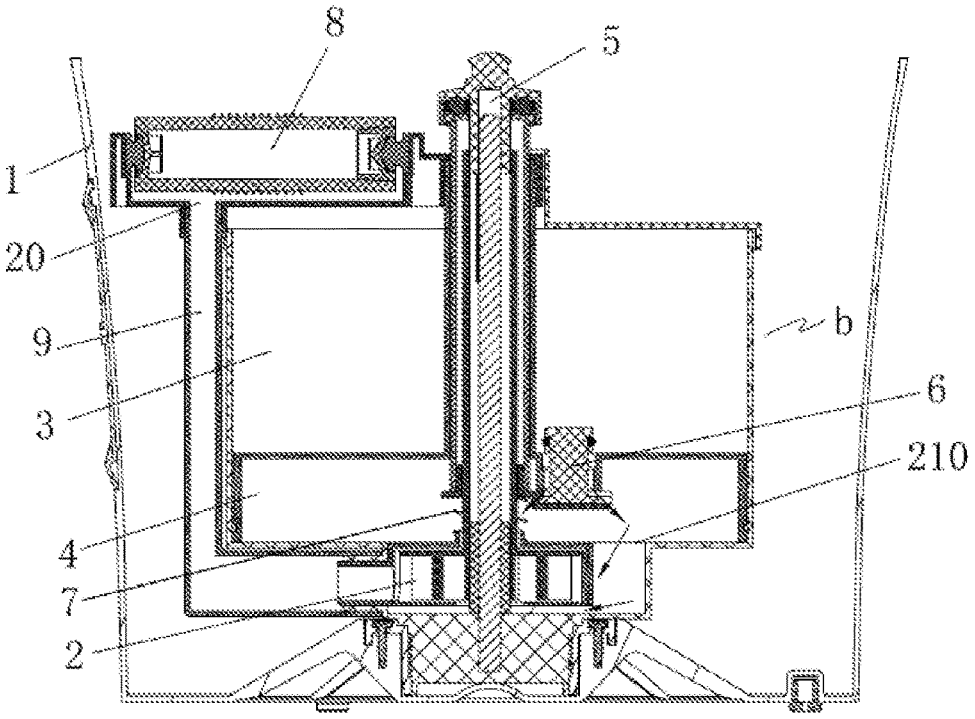
FIG. 5 is a structural diagram of the embodiment adopting a water cavity communicated with a cleaning roller.
Figure 6:
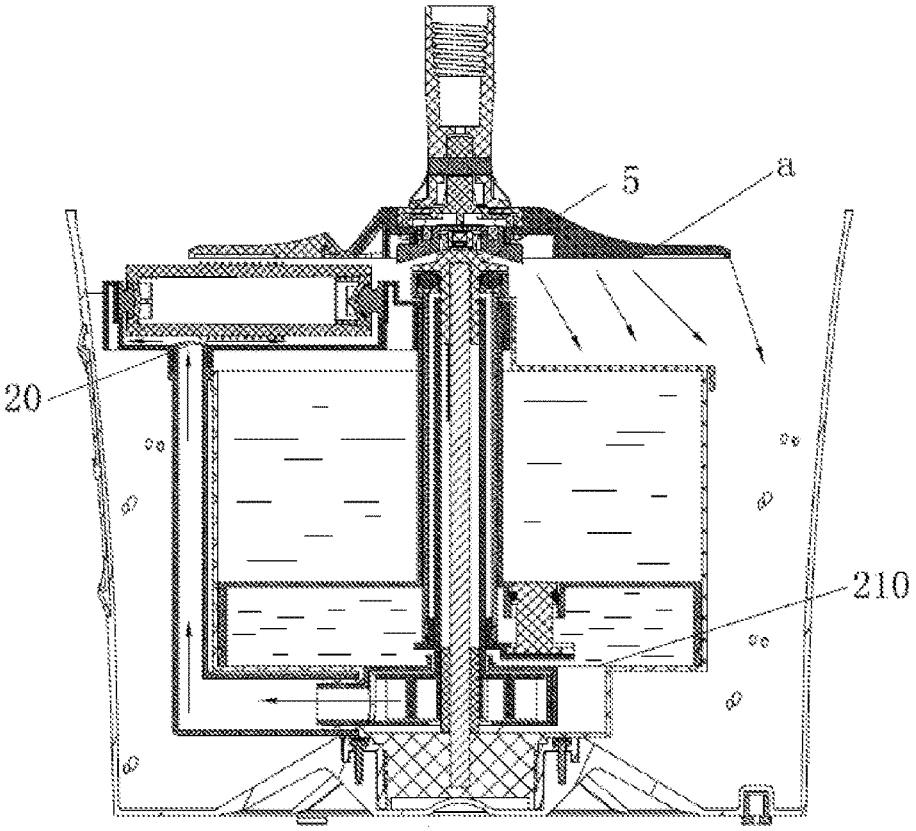
FIG. 6 is a structural diagram of the embodiment adopting water cavity communicated with the cleaning roller and used in cooperation with the mop.

Preferably, as shown in FIG. 5 and FIG. 6, in this embodiment, a water outlet 20 of the water pump 2 is connected to a water cavity 9 through a pipe, and a cleaning roller 8 which rotates with the axis thereof as a rotation axis is rotatably arranged in the water cavity 9. When the mop is cleaned, the mop head a rotates to drive the cleaning roller 8 to rotate, and the water pump 2 pumps water from the small cavity 4 and then delivers the water the mop head a by means of the cleaning roller 8. In a specific implementation, the water cavity 9 is supported by the outer bucket 1 and is fixedly connected to the outer bucket 1 or a derivative part of the outer bucket 1. In this embodiment, the water pump 2 pumps water from the small cavity 4 and then delivers the water to the mop head a by means of the cleaning roller 8, and in the using process, the cleaning roller 8 makes contact with the mop head a, so that the cleaning effect is improved; and when water is stored in the water cavity 9, the cleaning roller 8 rotates to bring water to the mop head a, and under the effect of the cleaning roller 8, water can be distributed on the mop head a more uniformly.

Preferably, the big cavity 3 and the small cavity 4 are formed by partitioning an inner bucket b which is arranged in the outer bucket 1, a partition plate b1 is arranged in the inner bucket b, and a gap is formed between the partition plate b1 and the inner wall of the inner bucket b; the partition plate b extends from an opening to the bottom of the inner bucket b and is connected to the inner wall or the bottom surface of the inner bucket b, a space formed between the outer side of the partition plate b1 and the inner bucket b is the big cavity 3, a space defined by the inner side of the partition plate b is the small cavity 4, and the partition plate b1 has a water passage. In a specific implementation, the water outlet 20 of the water pump 2 is close to the central axis of the support 5, the inner bucket b is fixedly connected to the outer bucket 1, and the upper surface of the big cavity 3 formed between the outer side of the partition plate b1 and the inner bucket b is impervious and is covered with a shield plate b2 or an extension part of the partition plate b1, so that water generated during centrifugal spin-drying will not flow into the big cavity 3, and thus, clean water and waste water will not be mixed. In this embodiment, the outlet of the water pump 2 is formed inside the inner side of the partition plate b1, water out of the water outlet 20 is sprayed to the mop head a, is then diffused from inside to outside under the effect of centrifugal force, and finally is collected and temporarily stored in the outer bucket 1, and the waste water can be poured out of the outer bucket 1 later. Through such configuration of the big cavity 3 and the small cavity 4, the structure is compact, and the internal space of the outer bucket 1 can be fully used.

In another implementation, the small cavity 4 is arranged in the outer bucket 1, and the big cavity 3 is arranged close to the small cavity 4, is located inside or outside the outer bucket 1, and supplies water to the small cavity 4.

Further preferably, in this embodiment, the partition plate b1 is centrally symmetrically distributed with respect to the central axis of the inner bucket b, and the support 5 is coaxial with the inner bucket b.

Further preferably, in this embodiment, the mop cleaning device further comprises an elastic part 7 capable of applying a force to the valve 6 to enable the valve 6 to open the water passage between the big cavity 3 and the small cavity 4; and when placed on the support 5, the mop head a overcomes the resistance from the elastic piece 7, and the valve 6 closes the water passage between the big cavity 3 and the small cavity 4. The elastic part 7 is a spring or a torsion spring which can hold the valve 6 to open the water passage in the absence of an external force; and when the acting force from the spring or the torsion spring is overcome by an external force, the valve 6 closes the water passage.

Preferably, in this embodiment, the water passage is a through hole formed in the partition plate b1, and the valve 6 is a plug connected to the cylinder 21, the elastic part 7 applies a force to the plug or the cylinder 21 to enable the plug to move away from the through hole; and when the mop head a is placed on the support 5, the cylinder 21 overcomes the resistance from the elastic part 7 to drive the plug to move close to the through hole to block the water passage.

Further preferably, an inner cylinder 23 is arranged in the cylinder 21, a gap is formed between the inner cylinder 23 and the cylinder 21, and the inner cylinder 23 is coaxial with the cylinder 21 and is fixedly or rotatably connected to the cylinder 23. Through the configuration of the inner cylinder 23 in the cylinder 21, the support body 5 may not be connected to the inner cylinder 23, and the elastic part 7 can directly act on the inner cylinder 23 to indirectly act on the valve 6 to enable the plug to move away from the through hole; and when the mop head 5 is placed on the support 5, the cylinder 21 overcomes the resistance from the elastic part 7 to drive the plug to move close to the through hole to block the water passage.

Preferably, the water outlet 20 of the water pump 2 is formed in an inner bucket b area, wherein the inner bucket b area refers to an upward projection area of the inner bucket b. Because water is diffused outwards from the center when the mop is centrifugally spin-dried, the whole mop head a can be cleaned during cleaning by forming the water outlet 20 in the middle.

Preferably, the inner bucket b, the cylinder 21 and the support 5 are arranged coaxially, and the cylinder 21 is arranged inside the inner side of the partition plate b1.

Figure 7:
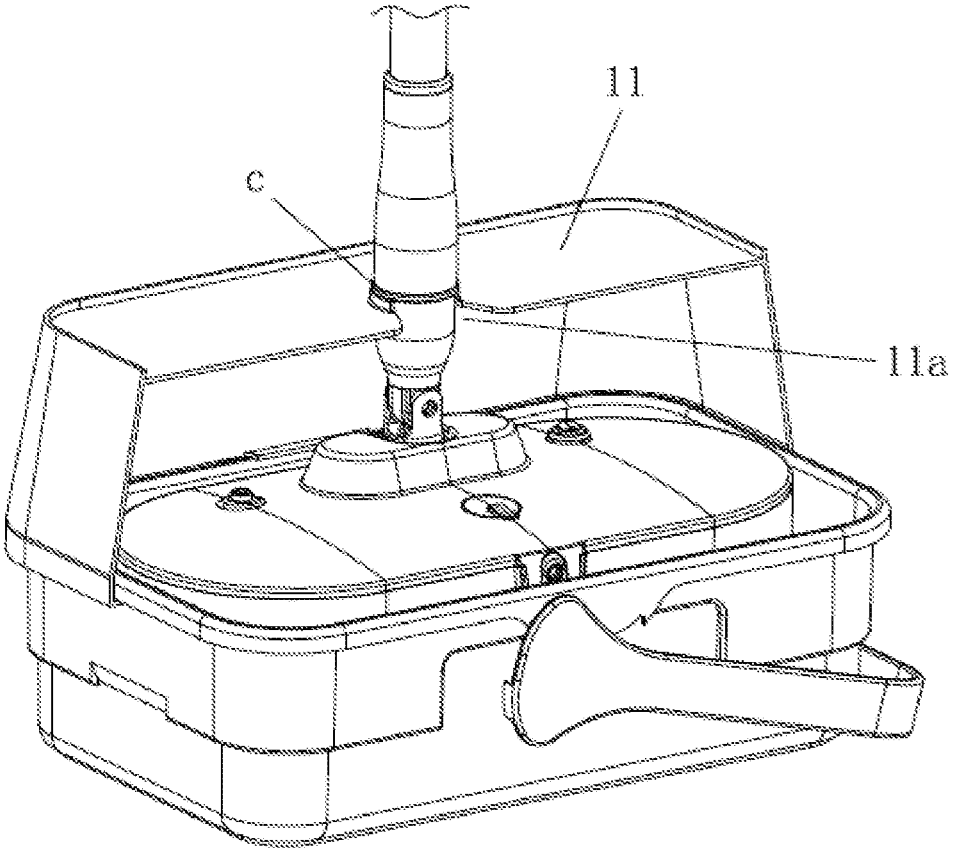
FIG. 7 is a schematic diagram of another mop support structure of the embodiment.

In the above embodiment, the support 5 partially or entirely supports the mop in the vertical direction. In the case where the support 5 partially supports the mope, as shown in FIG. 7, a support frame 11 is arranged on the outer bucket 1, and a hanger c is arranged on a mop rod of the mop; when the mop is cleaned, the mop head a abuts against the support 5, moves downwards and is then supported by the support frame 11. In this case, the mop is mainly supported by the support frame 11. Preferably, a notch 11*a* is formed in the support frame 11 and has an inner diameter smaller than the outer diameter of the hanger c, and an opening is formed in a lateral part of the notch 11*a*; and after entering the notch 11*a* via the opening, the mop rod will be restrained from moving downwards due to the fact that the outer diameter of the hanger c is greater than the inner diameter of the notch 11*a*, and thus, the mop is supported. In the case where the support 5 entirely supports the mop, as shown in FIG. 4 and FIG. 6, neither the support frame 11 nor the hanger c is configured, the support 5 is connected to the valve 6 and controls the valve 6, and after the valve 6 is adjusted in place, the mop head a is supported by the support 5 in the vertical direction.

The aforesaid contents in the specification are only used to illustratively explain the invention. Various modifications or supplements or similar substitutions made to the aforementioned specific embodiments by those skilled in the art without deviating from the contents of the specification or going beyond the scope defined by the claims should also fall within the protection scope of the invention.

What is claimed is:

1. A mop cleaning device comprising: a water pump; a first cavity; and a second cavity; wherein the first cavity and the second cavity are used for storing a liquid, a water volume of the first cavity is greater than a water volume of the second cavity; the first cavity communicates with the second cavity; a valve for controlling communication of the first cavity and the second cavity is arranged between the first cavity and the second cavity, and the water pump communicates with the second cavity and pumps water from the second cavity; and when a mop is cleaned, the valve is controlled to close a water passage between the first cavity and the second cavity, and the water pump pumps the water from the second cavity to the mop to fulfill a cleaning.

2. The mop cleaning device according to claim 1, further comprising an outer bucket, wherein the outer bucket is provided with a support abutting against a mop head of the mop.

3. The mop cleaning device according to claim 1, wherein after the water in the second cavity is used up, the mop rotates to be centrifugally spin-dried.

4. The mop cleaning device according to claim 2, wherein the support is movably arranged in a vertical direction; and the mop is placed on the support when cleaned, and then the support moves downwards to drive the valve to close the water passage between the first cavity and the second cavity.

5. The mop cleaning device according to claim 2, wherein the mop head of the mop is placed on the support, and when rotating, the mop head of the mop drives the water pump to pump the water from the second cavity to the mop.

6. The mop cleaning device according to claim 1, wherein the water pump is an impeller pump.

7. The mop cleaning device according to claim 2, wherein the water pump comprises a cylinder formed with a water inlet, a spiral blade spirally extends along an inner wall of the cylinder from bottom to top and the spiral blade is arranged in the cylinder, and the cylinder rotates with respect to the outer bucket.

8. The mop cleaning device according to claim 7, wherein an inner diameter of the cylinder is gradually increased from bottom to top.

9. The mop cleaning device according to claim 7, wherein the support is fixedly connected to the cylinder.

10. The mop cleaning device according to claim 7, wherein the first cavity and the second cavity are formed by partitioning an inner bucket, the inner bucket is arranged in the outer bucket; a partition plate is arranged in the inner bucket, and a gap is formed between the partition plate and an inner wall of the inner bucket; the partition plate extends from an opening of the inner bucket to a bottom of the inner bucket and is connected to the inner wall of the inner bucket or a bottom surface of the inner bucket, a space formed between an outer side of the partition plate and the inner bucket is the first cavity, and a space defined by an inner side of the partition plate is the second cavity; and the partition plate has the water passage.

11. The mop cleaning device according to claim 1, wherein the second cavity is arranged in an outer bucket, and the first cavity is arranged adjacent to the second cavity.

12. The mop cleaning device according to claim 10, wherein the partition plate is centrally symmetrically distributed with respect to a central axis of the inner bucket, and the support is coaxial with the inner bucket.

13. The mop cleaning device according to claim 2, further comprising an elastic part, wherein the elastic part applies a force to the valve to enable the valve to open the water passage between the first cavity and the second cavity; and when the mop head of the mop is placed on the support, a resistance from the elastic part is overcome, and the valve closes the water passage between the first cavity and the second cavity.

14. The mop cleaning device according to claim 10, wherein the water passage is a through hole formed in the partition plate, the valve is a plug connected to the cylinder, and an elastic part applies a force to the plug or the cylinder to enable the plug to move away from the through hole; and when the mop head of the mop is placed on the support, the cylinder overcomes a resistance from the elastic part to drive the plug to approach the through hole to block the water passage.

15. The mop cleaning device according to claim 7, wherein the cylinder is an outer cylinder, an inner cylinder is arranged in the outer cylinder, a gap is formed between the inner cylinder and the outer cylinder, and the inner cylinder is coaxial with the cylinder and is fixedly or rotatably connected to the outer cylinder.

16. The mop cleaning device according to claim 15, wherein the inner cylinder is fixedly connected to the outer cylinder, and the support is fixedly connected to the inner cylinder.

17. The mop cleaning device according to claim 10, wherein a water outlet of the water pump is arranged in an area of the inner bucket, and an upper surface of the first cavity is impervious.

18. The mop cleaning device according to claim 10, wherein the inner bucket, the cylinder and the support are arranged coaxially, and the cylinder is arranged inside the inner side of the partition plate.

19. The mop cleaning device according to claim 1, wherein a water outlet of the water pump is connected to a water cavity through a pipe, and a cleaning roller rotates with an axis of the cleaning roller as a rotation axis and the cleaning roller is rotatably arranged in the water cavity; and when the mop is cleaned, a mop head of the mop rotates to drive the cleaning roller to rotate, and the water pump pumps the water from the second cavity and then delivers the pumped water to the mop head of the mop by means of the cleaning roller.

20. The mop cleaning device according to claim 1, wherein the mop is a rotary mop, an outer bucket is provided with a support frame, a mop rod of the mop is provided with a hanger, and when the mop is cleaned, the support frame supports the hanger to restraining the mop from moving downwards.

21. The mop cleaning device according to claim 20, wherein the support frame has a notch, and an inner diameter of the notch is smaller than an outer diameter of the hanger.

22. The mop cleaning device according to claim 3, further comprising an outer bucket, wherein the outer bucket is provided with a support abutting against a mop head of the mop.

23. The mop cleaning device according to claim 19, further comprising an outer bucket, wherein the outer bucket is provided with a support abutting against a mop head of the mop; wherein the support is movably arranged in a vertical direction; and the mop is placed on the support when cleaned, and then the support moves downwards to drive the valve to close the water passage between the first cavity and the second cavity.

* * * * *